United States Patent [19]
Neu
[11] 4,181,690
[45] Jan. 1, 1980

[54] VENTILATION AND AIR CONDITIONING UNIT

[75] Inventor: Francis Neu, Villeneuve d'Ascq, France

[73] Assignee: S.A. Delta Neu, Lille, France

[21] Appl. No.: 906,624

[22] Filed: May 16, 1978

[30] Foreign Application Priority Data

May 18, 1977 [FR] France ..... 77 16442

[51] Int. Cl.[2] ..... B01F 3/04

[52] U.S. Cl. ..... 261/29; 98/30; 261/36 R; 261/105; 261/106; 261/127; 261/141

[58] Field of Search ..... 261/29, 30, 36 R, 96, 261/103, 106, 109, 105, DIG. 4, DIG. 15, DIG. 17, DIG. 34, DIG. 41, 127, 141; 98/30, 33 R, 33 A

[56] References Cited

U.S. PATENT DOCUMENTS

| | | | |
|---|---|---|---|
| 908,963 | 1/1909 | Cramer | 261/30 |
| 1,726,214 | 8/1929 | Comins | 261/30 X |
| 2,063,711 | 12/1936 | Turner | 261/DIG. 34 |
| 2,144,693 | 1/1939 | Seid | 261/DIG. 34 |
| 2,495,538 | 1/1950 | Mousel | 261/DIG. 4 |
| 2,554,868 | 5/1951 | Mills | 261/30 X |
| 2,584,618 | 2/1952 | Robic | 261/DIG. 34 |
| 4,029,723 | 6/1977 | Morrison et al. | 261/29 |

FOREIGN PATENT DOCUMENTS

| | | | |
|---|---|---|---|
| 436769 | 6/1948 | Italy | 261/30 |
| 914466 | 1/1963 | United Kingdom | 261/101 |

*Primary Examiner*—Richard L. Chiesa
*Attorney, Agent, or Firm*—Fleit & Jacobson

[57] ABSTRACT

A ventilation and air conditioning apparatus operating according to the adiabatic evaporation principle and adapted to be fitted under a roof, the apparatus comprising a prismatic housing of which the bottom portion consists of an annular water-filled tank having in its central portion an upstanding frustoconical element having a vertical axis of which the vertex angle is at least 30 degrees. The major base of the element is connected in an air-tight manner to the tank, the minor base of this frustoconical element being disposed at the top and closed, and receives through it the vertical shaft of an electric motor driving a helical fan provided with relatively large blades rotating at a relatively slow speed and adapted to draw in air through a shaft of which at least the lower section is vertical and opens into the upper portion of the housing, while the upper section of this shaft opens into the external atmosphere.

8 Claims, 8 Drawing Figures

VENTILATION AND AIR CONDITIONING UNIT

The present invention relates in general to ventilation and air conditioning apparatus and has specific reference to an apparatus of this type operating by adiabatic evaporation and adapted to be mounted under roofs.

The cost of floor space and the ease of installation lead manufacturers to conceive air conditioning apparatus or units disposed on terraces, flat roofs or balconies in large buildings. However, they are objectionable in that they are ill suited for very moderately pitched roofs, require cumbersome networks of blowing or ventilation shafts, and constitute unaesthetic projections on roofs and the like.

It is the essential object of the present invention to provide a novel industrial product capable of avoiding the above-mentioned inconveniences and having characteristic features such that manufacturing, installation and maintenance costs are reduced considerably, thus affording a wide field of application of cooled ventilation to relatively large rooms and premises.

The invention especially relates to a ventilation and air conditioning apparatus operating according to the adiabatic evaporation principle and adapted to be fitted under a roof, characterized in that it comprises a prismatic housing of which the bottom portion consists of an annular water-filled tank having in its central portion an upstanding frustoconical element having a vertical axis of which the vertex angle is at least 30 degrees, the major base of said element being connected in an air-tight manner to the tank, the minor base of this frustoconical element being disposed at the top and closed, and receiving through it the vertical shaft of an electric motor driving a helical fan provided with relatively large blades rotating at a relatively slow speed and adapted to draw in air through a shaft of which at least the lower section is vertical and opens into the upper portion of said housing, the upper section of this shaft opening into the external atmosphere; the vertical walls of said housing being amply open to constitute windows closed by detachable pockets filled with wood chips to constitute a filtration mat, said pockets being sprinkled continuously with water taken from said bottom tank by a pump delivering said water continuously in a closed circuit fashion into an upper conduit, said circuit further comprising on the one hand a water inlet for keeping the water level at a constant value and on the other hand a water recycling valve.

The invention will now be described with reference to typical forms of embodiment illustrated in the accompanying drawings and given by way of example. In the drawings.

Figure 1:
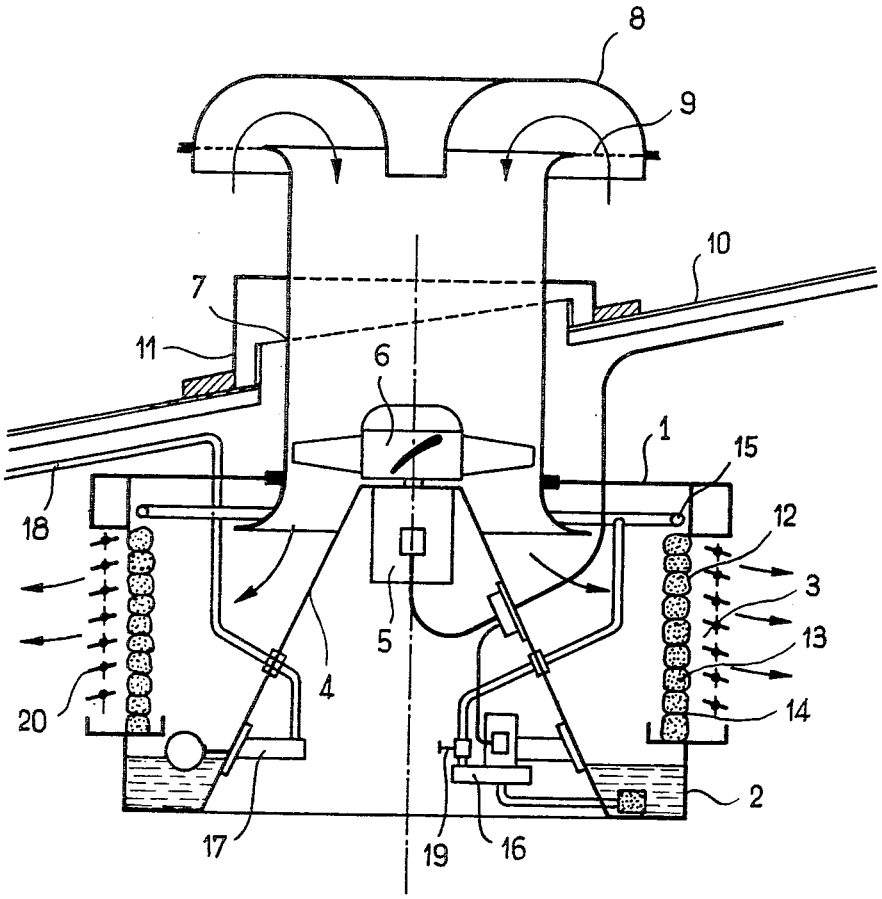
FIG. 1 is a diagrammatic vertical section showing a first form of embodiment of the ventilation and air conditioning apparatus according to this invention.

The ventilation and air conditioning apparatus according to this invention, as illustrated in FIG. 1 showing the simplest version thereof, comprises a housing 1 of which the annular base 2 is fluid-tight and constitutes a water tank. The vertical walls of this housing are polygonal and provided with openings 3 permitting the passage of air. The centre of the apparatus is constituted by a frustoconical element 4 having a vertical axis, and its bottom base is connected in a fluid-tight manner to the water-tank forming base 2, the vertex angle of the cone being at least 30 degrees. This element 4 has mounted under its upper minor base an electric motor 5 of which the stud shaft carries a fan wheel 6 drawing air through an upstream shaft or conduit 7 of which at least the portion surrounding the fan wheel 6 is of revolution. Overlying this shaft or conduit 7 is a protection cap 8 preventing the ingress of atmospheric precipitations; this cap 8 is provided with a grid 9 preventing the ingress of insects or birds. In the Figure, the shaft or conduit 7 is rectilinear and vertical, but it is an essential feature of this invention to provide an elbow-shaped shaft as shown by way of example in FIG. 2 notably for fitting the apparatus under shed roofs. The necessary water-tightness between the shaft 7 and the roof 10 may be obtained if desired by means of a coaming such as the one shown at 11 in FIG. 1.

Another essential feature characterizing this invention is that each opening 3 is provided with a pocket 12 consisting of an air-pervious casing 13 of flexible straining material containing a pack of wood fibres, the two opposite walls being kept at a constant relative spacing by means of transverse polyamid yarns such as 14 disposed at spaced intervals and extending through the pack in order to prevent the fibres from becoming unduly compressed. A conduit 15 is provided for properly distributing water upon the upper portion of the pockets 12, so that the water will impregnate the wood fibres and the excess water not evaporated by the air stream passing through the pockets 12 is returned to the tank 2 from which it is sucked out by an electric motor and pump unit 17 connected to a water supply line 18 for constantly keeping the water at the same level in said tank 2.

An adjustment valve 19 disposed on the delivery side of pump 16 allows a proper control of the water output; this valve 19 may be controlled manually, but an automatic actuation thereof is preferred.

Another essential feature characterizing this invention is that the humidification pockets are followed by pivoted horizontal louvre blades 20 mounted in a relatively tight fit and adapted to regulate the direction and speed of the air stream, and therefore the air flow range, as a function of the physical characteristics of the room equipped with the apparatus of the invention.

Figure 2:
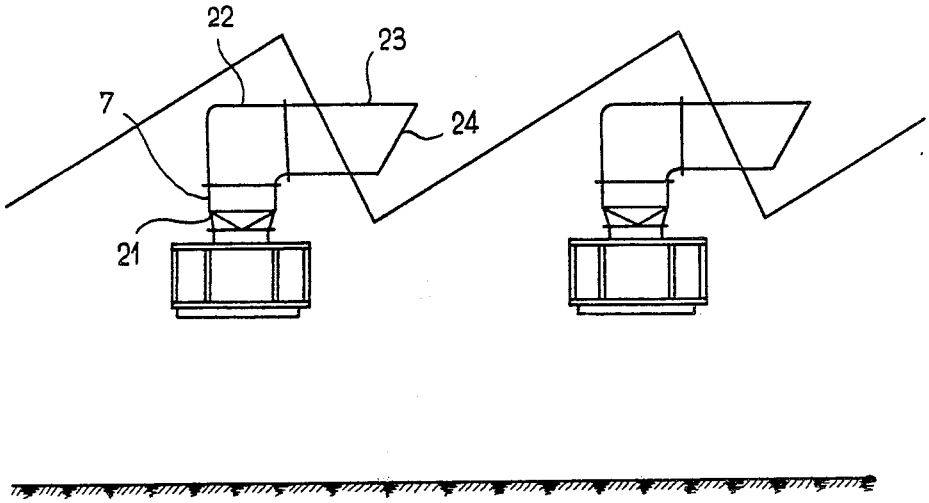
FIG. 2 is a diagrammatic elevational view showing devices according to this invention mounted on shed roofs.

FIG. 2 is a vertical section showing very diagrammatically a shed roof equipped with apparatus according to the instant invention, each apparatus being installed in the hollows of the roof, as shown, thus sparing floor space and permitting of dispensing with air distribution shafts, the faces of the apparatus acting as air vents, or ventilation air outlets.

Figure 3:
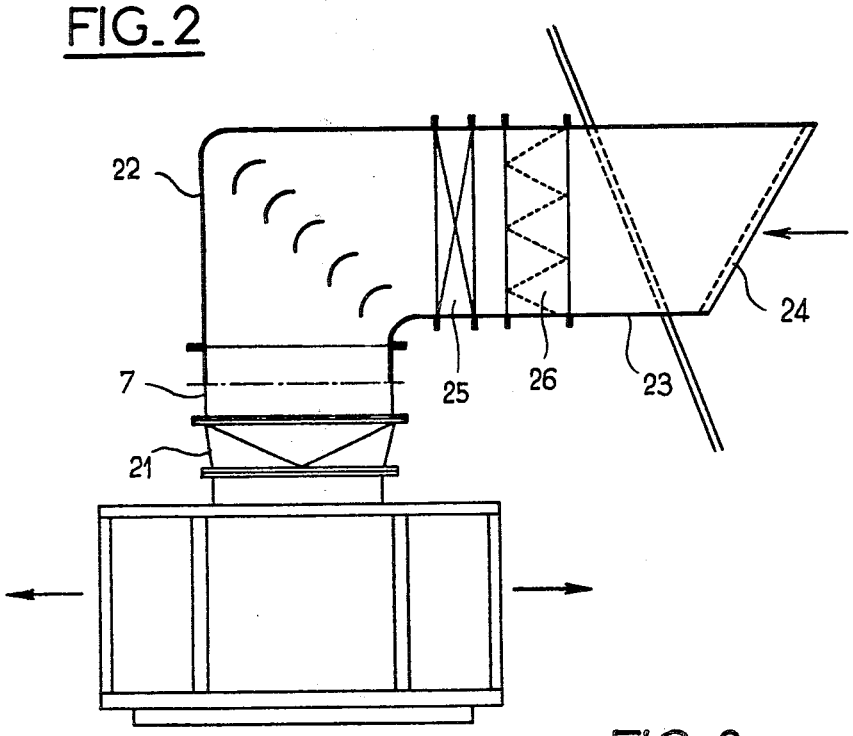
FIG. 3 is a partially vertical section and elevational view of a typical form of embodiment of an apparatus incorporating an elbow in the upstream shaft.

In this arrangement, as illustrated more in detail in FIG. 3, the shaft 7 has a rectangular cross-section and is connected to the fan by means of a connecting section 21 converting the rectangular section into a circular section; overlying this shaft 7 is a 90-degree elbow provided with fins and supplied with atmospheric air via a rectangular-sectioned horizontal conduit section 23 protected by a vizor 24.

In the modified arrangement illustrated in FIG. 3 an air heater 25, for example of the stream, hot-water or electric type, is provided downstream of an air filter 26.

Figure 4:
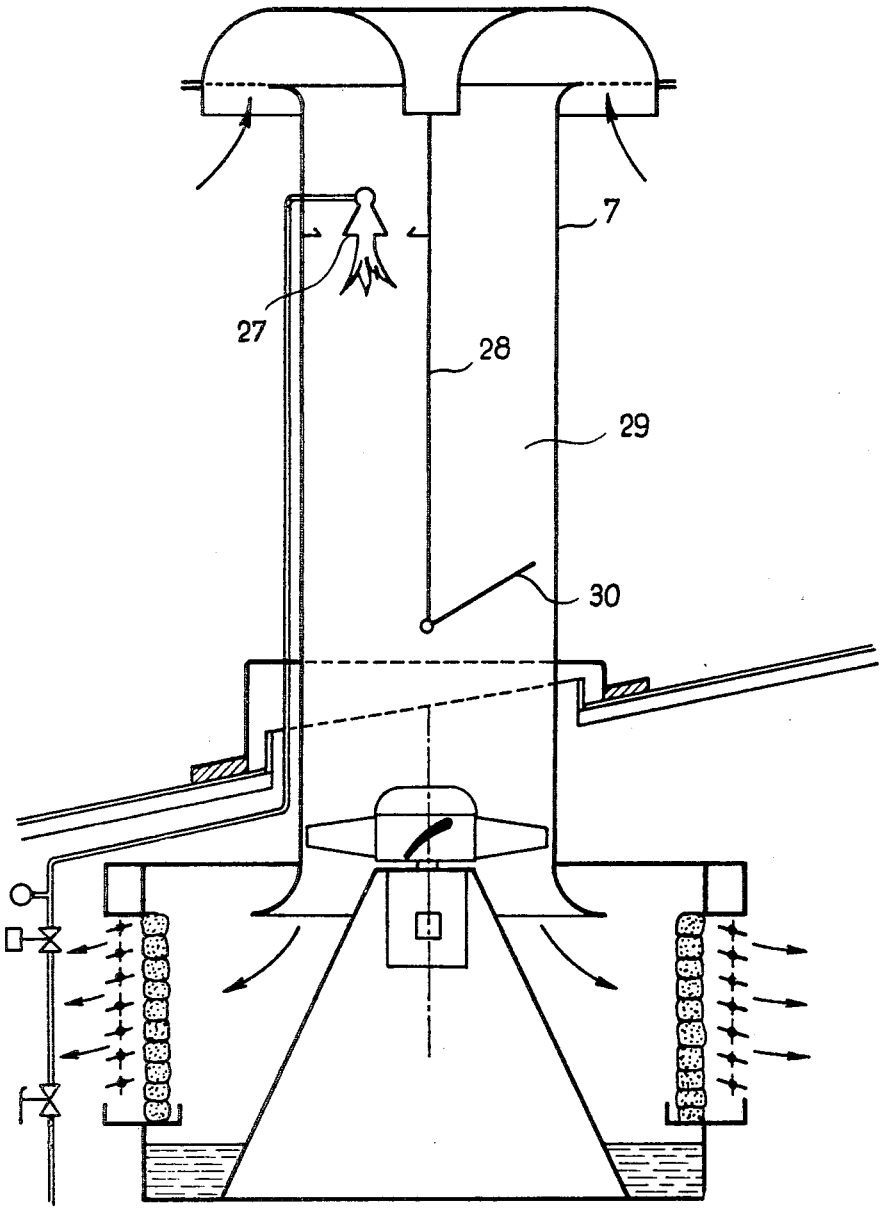
FIG. 4 is a section similar to FIG. 1 showing an apparatus equipped with a burner for heating the incoming air stream.

This invention also contemplates the heating of atmospheric incoming air in winter by means of a direct combustion of gas in the stream of fresh incoming air, as illustrated in FIG. 4, a burner 27 being disposed in this case in one portion conduit 7, the latter being divided into two halves by an intermediate longitudinal partition 28, the other burner-free section 29 being adapted to be closed at will by means of a damper 30 in order to properly proportion the air output flowing through the burner 27 as a function of the gas output implemented.

Figure 5:
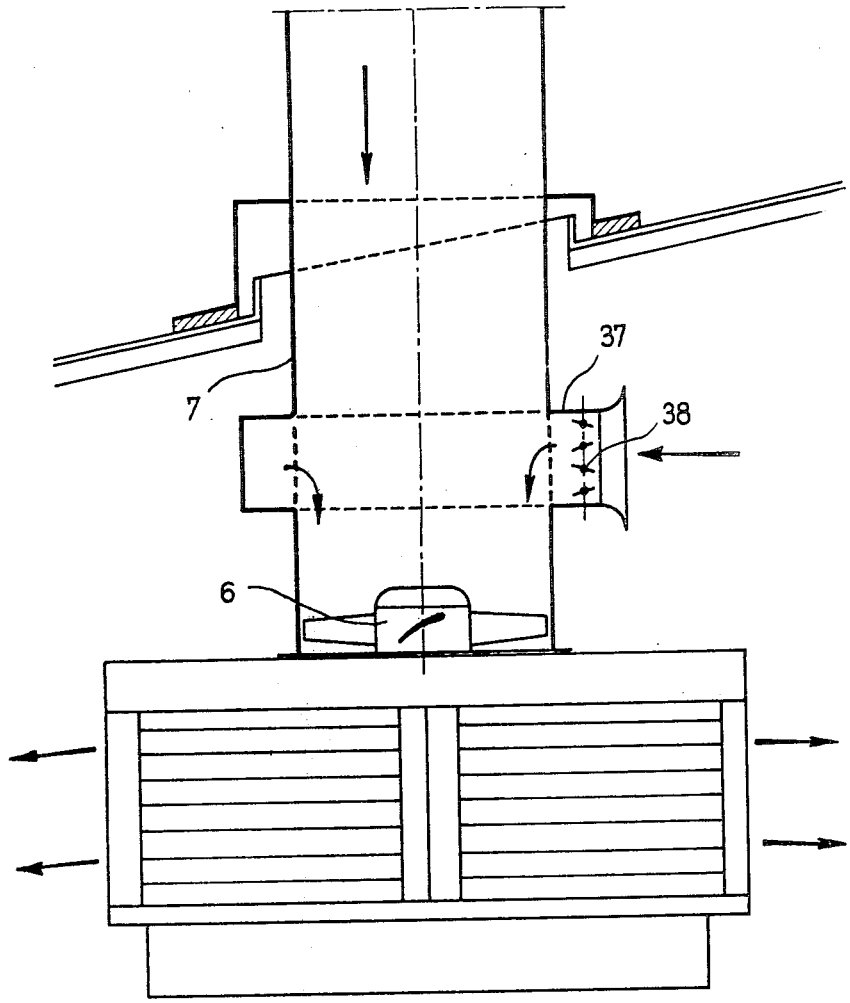
FIG. 5 is a fragmentary section showing an apparatus equipped with an air recycling by-pass mounted in the upstream shaft.

This invention also provides, in this case, a by-pass 37 disposed upstream of the fan for recycling, if desired, the internal air in the building, if this mode of operation, as illustrated in FIG. 5, can be used between the roof and the fan wheel 6, the air circulation in this by-pass being adapted to be controlled by means of an adjustable damper 38. However, for safety reasons, this by-pass is not used if the apparatus comprises means for heating the incoming fresh air by means of a direct-flow burner 27 of the type illustrated in FIG. 4.

Figure 6:
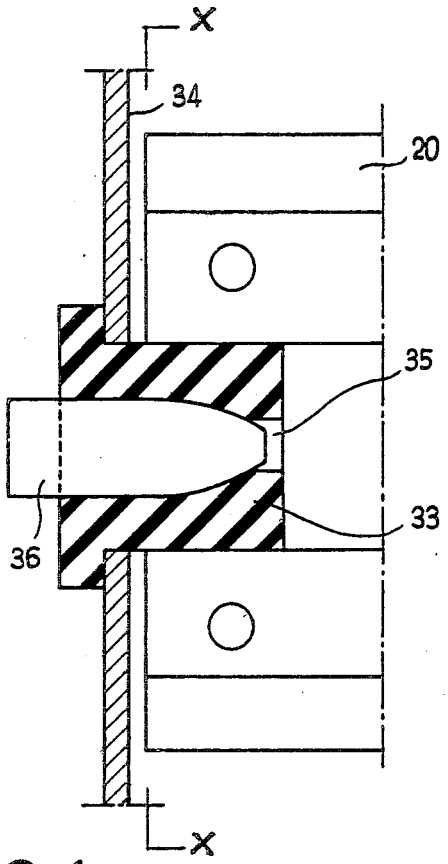
FIG. 6 is a detail view showing in axial section the mounting of louvre blades.
Figure 7:
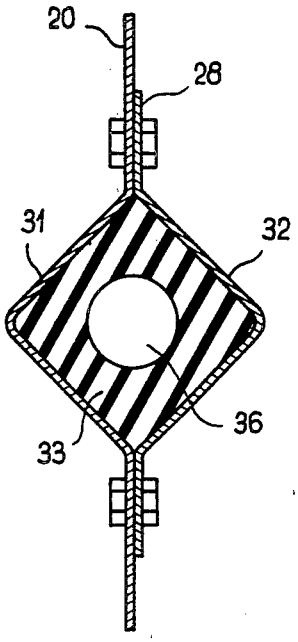
FIG. 7 is a cross section taken along the line X—X of FIG. 6.

A remarkable feature characterizing this invention lies in the fact that the louvres 20 are arranged as illustrated in FIG. 6, the latter being a section taken along the axis of pivotal mounting of the louvre blades, and in FIG. 7 which is a section taken at right angles to this axis. Each louvre blade comprises a central rib 31 adapted in conjunction with a counter-plate 32 in which an identical opposite rib 40 is formed, to constitute a longitudinal cavity engageable at either end by rubber plugs 33 also engaging circular holes formed in the vertical walls 34 of openings 3. The plugs 33 comprise a central bore 35 into which a pin 36 of a diameter slightly greater than that of the corresponding bore 35 is adapted to be inserted in order to lock the louvre blade in the desired position.

The above-described arrangements provide an apparatus adapted to be easily fitted into position, without having to manufacture or fit shafts, air distribution outlets or air recycling conduits, while affording a very efficient treatment of the atmosphere of very large rooms and premises. In its simplest form of embodiment, the apparatus according to this invention is capable of ventilating building inner spaces both in winter and between-season times, and also of conditioning the air of rooms by adiabatic evaporation in the summer, i.e. by blowing air at a temperature lower than that of the external atmosphere, since this ventilation air is rather close to its humid ball temperature, the air being brought under constant enthalpy to a relative humidity sometimes in excess of 75%.

Figure 8:
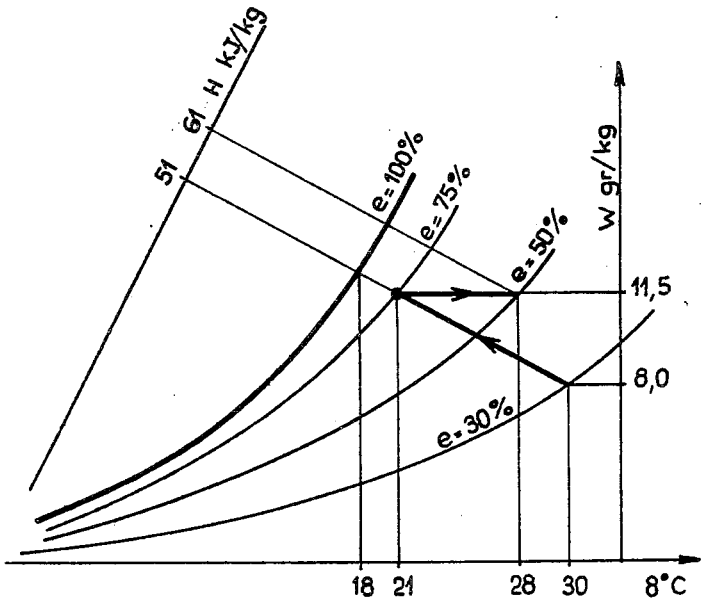
FIG. 8 is a conventional diagram concerning the humid air.

For example, assuming that the atmospheric air temperature is 30° C. and the relative humidity is 30%, the blowing temperature may be reduced to 21° C., and it will be possible, in a room equipped with the apparatus of this invention, to obtain a temperature inferior to that of the external atmosphere if a sufficient air input is selected, whereas in the case of a simple ventilation the temperature would compulsorily be higher than that of the external atmosphere. In this example, if the rise in sensitive heat is 10 kJ per kilogram of dry air blown into the room, the room atmosphere temperature will reach 28° C., as shown in FIG. 8 which is a conventional humid air diagram, wherein:

O=temperature in degrees C.,
W=specific humidity g/kg,
e=relative humidity (%),
H=enthalpy J/kg.

According to this invention, the tank 2 may be provided with a draining hole possibly connected permanently to a sewer and provided with a shut-off or adjustment valve for deconcentration or blow-off purposes. This last-mentioned function may be obtained by providing a pick-up inserted in the delivery side of the pump 16 or at a suitable location along the conduit 15, and connected to the sewer with the interposition of a valve.

The addition of filter means, air heating means, by-passes, according to this invention permits of performing all the functions normally expected from an adiabatic water evaporation room air-conditioning system.

The absence of any compressor and the choice of a helical fan having blades of relatively large surface area and revolving at a relatively slow speed afford a noiseless, vibration-free operation. The provision of pockets 12 impart a long maintenance-free operation and facilitates greatly the replacement of parts.

The air distribution adjustment blades afford on the other hand an economical manufacture and an easy assembling; the electric motors are disposed externally of the air circuit and therefore they are easily accessible. The air filtration is particularly efficient and takes place in a humid medium.

In such versions comprising means for heating the air, sprinkling the pockets 12 will permit increasing and adjusting the relative humidity in the room.

What I claim as new is:

1. Ventilation and air conditioning apparatus operating according to the adiabatic evaporation principle and adapted to be fitted under a roof, said apparatus comprising a prismatic housing of which a bottom portion comprises an annular water-filled tank having in its central portion an upstanding frustoconical element having a vertical axis of which the vertex angle is at least 30 degrees, the major base of said element being connected in an air-tight manner to the tank, the minor base of this frustoconical element being disposed at the top and closed, and receiving through it a vertical shaft of electric motor means driving a helical fan provided with relatively large blades rotating at a relatively slow speed and adapted to draw in air from a first conduit directing external air to the fan and equipped with an air heater through a second conduit of which at least a lower section is vertical and opens into an upper portion of said housing, an upper section of the second conduit opening into the external atmosphere, said housing having vertical walls with apertures formed therein closed by detachable pockets filled with wood chips to constitute a filtration mat, said pockets being sprinkled continuously with water taken from said water-filled tank by a pump delivering said water continuously in a closed-circuit fashion into an upper conduit, said circuit further comprising on the one hand a water inlet for keeping the water level at a constant value and on the other hand a water recycling valve, said apertures being provided, downstream of the pockets, with a plurality of horizontal louvre blades adapted to be set in any desired inclined position, each blade being mounted for tight-fit pivotal movement about a horizontal axis.

2. Apparatus according to claim 1, wherein the conduit supplying air to the fan is equipped with a prefilter.

3. Apparatus according to claim 1, wherein the conduit supplying air to said fan is equipped with a by-pass opening into the room, between the roof and the fan.

4. Apparatus according to claim 1, wherein the axes of said louvre blades are comprised of rubber tubular sections inserted into holes formed in the vertical walls of said apertures and in ribs formed in each blade, and also in complementary ribs formed in a counter-plate associated with each blade, said rubber tubular sections being adapted to be expanded by means of pins driven into their bores in order to lock the blades in desired position.

5. A ventilation and air conditioning apparatus operating according to the adiabatic evaporation principle and adapted to be fitted under a roof, said apparatus comprising a prismatic housing of which a bottom portion comprises an annular water-filled tank having in its central portion an upstanding frustoconical element having a vertical axis of which the vertex angle is at least 30 degrees, the major base of said element being connected in an air-tight manner to the tank, the minor base of the frustoconical element being disposed at the top and closed, and receiving through it a vertical shaft of an electric motor driving a helical fan provided with relatively large blades rotating at a relatively slow speed and adapted to draw in air through a shaft of which at least the lower section is vertical and opens into an upper portion of said housing, the upper section of the shaft opening into the external atmosphere; the housing having vertical walls with apertures formed therein closed by detachable pockets filled with wood chips to constitute a filtration mat, said pockets being sprinkled continuously with water taken from said water-filled tank by a pump delivering said water continuously in a closed-circuit fashion into an upper conduit, said circuit further comprising on the one hand a water inlet for keeping the water level at a constant value and on the other hand a water recycling valve, the vertical walls having downstream of the pockets a plurality of horizontal louvre blades adapted to be set in any desired inclined position, said blades each mounted for tight-fit pivotal movement about a horizontal axis and having axes comprised of rubber tubular sections inserted into holes formed in each blade, and also in complementary ribs formed in a counter-plate associated with each blade, said rubber tubular sections being adapted to be expanded by means of pins driven into their bores in order to lock the blades in desired position.

6. Apparatus according to claim 1, wherein the conduit directing external air to the fan is equipped with an air heater.

7. Apparatus according to claim 1, wherein the conduit supplying air to the fan is equipped with a pre-filter.

8. Apparatus according to claim 1, wherein the conduit supplying air to said fan is equipped with a by-pass opening into the room, between the roof and the fan.

* * * * *